United States Patent [19]

Kato

[11] Patent Number: 5,024,149

[45] Date of Patent: Jun. 18, 1991

[54] BINDING STRAP OPERATING APPARATUS

[75] Inventor: Kanami Kato, Saiai, Japan

[73] Assignee: Signode Corporation, Glenview, Ill.

[21] Appl. No.: 335,956

[22] Filed: Apr. 10, 1989

[30] Foreign Application Priority Data

Apr. 15, 1989 [JP] Japan ..... 63-94337

[51] Int. Cl.[5] ..... B65B 13/22

[52] U.S. Cl. ..... 100/32; 100/29; 53/589

[58] Field of Search ..... 100/29, 32, 26, 33 PB; 53/589

[56] References Cited

U.S. PATENT DOCUMENTS 4,212,238 7/1980 Simmons et al. ..... 100/32
4,683,017 7/1987 Figiel et al. ..... 53/589 X
4,845,928 7/1989 Sakaki et al. ..... 53/589

FOREIGN PATENT DOCUMENTS 753716 8/1980 U.S.S.R. ..... 100/32

*Primary Examiner*—Philip R. Coe
*Assistant Examiner*—Stephen F. Gerrity
*Attorney, Agent, or Firm*—Schwartz & Weinrieb

[57] ABSTRACT

Strap binding apparatus is disclosed as including a traction wheel (2T) and a back-up wheel (2B) wherein the traction wheel (2T) is rotatably mounted upon an axis (t) which is fixed within a binding head framework, while the back-up wheel (2B) is rotatably mounted upon an axis (b) which is eccentrically disposed, by means of an eccentric shaft (10), with respect to a base axis (X) through means of an eccentric distance (x). A support plate (9) is pivotably mounted within the binding head framework about the axis (t) and is biased in its pivotable movement by means of a spring (8) interposed between the support plate (9) and the binding head framework. A lever (10*a*) is mounted upon the eccentric shaft (10), and a linkage member (11) has one end thereof connected to the lever (10*a*) and the other end thereof connected to the support plate (9) such that upon pivotable movement of the support plate (9) under the biasing influence or force of the spring (8), the back-up wheel (2B) is rotated into engagement with the traction wheel (2T). The degree to which the back-up wheel (2B) is rotated into engagement with the traction wheel (2T) is adjustable either by changing the length of the linkage member (11) or by altering the connection location defined between the lever (11) and the support plate (9) at any one of the plurality of holes (9*a*) formed within support plate 9.

10 Claims, 3 Drawing Sheets

FIG. 3a PRIOR ART
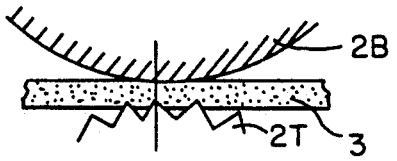
FIG. 3b
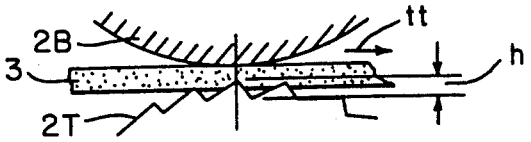
FIG. 4b
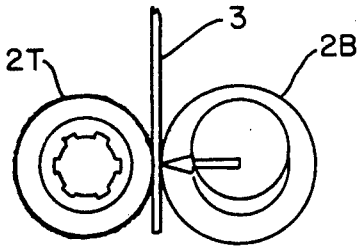
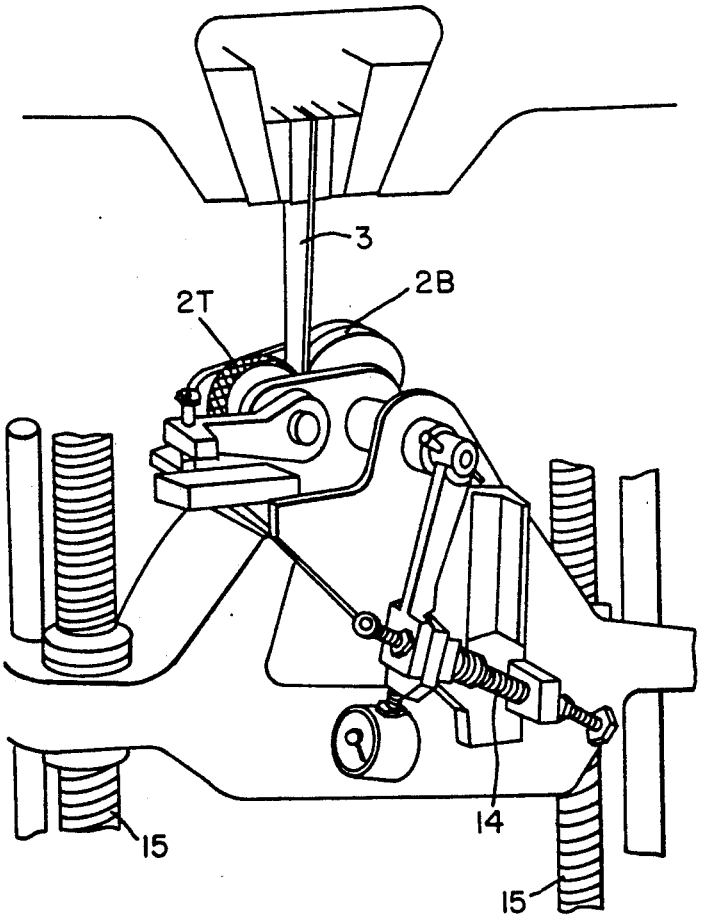
FIG. 4a

BINDING STRAP OPERATING APPARATUS

FIELD OF THE INVENTION

The present invention relates generally to binding apparatus for securely binding heavy articles, such as, for example, strip coils, tubes, stacked plates, and the like, with a steel-band strap, and more particularly to binding apparatus which incorporates therein a mechanism for adjusting the relative disposition of the back-up wheel with respect to the traction wheel so as to selectively or adjustably vary the wedging angle defined between the traction and back-up wheels when the wheels are engaged with each other during both forward feeding and reverse tightening/tensioning modes of operation.

BACKGROUND OF THE INVENTION

With reference being initially made to FIGS. 5–7 of the drawings, a strap-binding operation of the type noted hereinabove is conventionally carried out by means of a multi-functional binding head 1 which is vertically movable with respect to the frame of the binding machine. As more particularly shown in FIG. 5, the strap binding process or operation, as performed by means of such conventional strap-binding apparatus, comprises the steps of feeding a band-like binding strap 3 in a forward feeding direction f by means of forward rotation of reversible-drive rollers 2 such that the binding strap 3 encircles an article 4 to be bound. Upon completion of, in effect, a closed loop around the article 4, the leading end portion 3*a* of the binding strap 3 is gripped by means of a gripper apparatus or unit, not shown, disposed within the binding head 1, and subsequently, the rotational drive of the drive rollers 2 is reversed such that the trailing end portion 3*b* of the binding strap 3 is retracted in the reverse direction tt such that the binding strap 3 is preliminarily tightened about the article 4 being bound. Subsequently, the reverse drive of the rollers 2 is continued whereby the binding strap 3 is tightened about the article 4 with a high degree of tension, and while the strap 3 is disposed in such a tensioned state, the overlapped leading and trailing end portions 3*a* and 3*b* of the binding strap 3 are bonded together at a location which is disposed downstream of the gripping station at which the gripping unit is disposed, by means of a seal fitment or crimped ferrule, or the like.

Continuing further, after the overlapping strap portions 3*a* and 3*b* have been bonded to each other, the bonded trailing end portion 3*b* of the strap 3 is severed and separated from the residual supply portion 3*c* of the binding strap 3. In performance of the bonding operation, crimping means, not shown, operatively cooperate with an underlay or undersurface support plate or block, also not shown, which is interposed between the article 4 being bound and the overlapped portions 3*a* and 3*b* of the binding strap 3. Consequently, upon completion of the bonding operation, the underlay or support block is transversely removed from its position between the bound article 4 and the overlapped portions 3*a* and 3*b* of the binding strap 3 whereby the bonded strap 3 disposed about the bound article 4 is loosened to a predetermined degree corresponding to the volume of the gap space vacated by means of the removed underlay or support block. However, in view of the highly tensioned state existing within the bound binding strap, and the inherent resiliency developed therein, such looseness or slack developed within the bound binding strap is immediately absorbed so that the tensioned bound state is in fact sufficiently maintained.

Reference now being made to FIG. 6 of the drawings, there is shown the drive roller system 2 which is disposed within the conventional binding head 1, and FIG. 7 specifically illustrates, in a schematic mode, the interacting dynamics developed between the traction roller 2T and the back-up roller 2B. More particularly, the traction roller or traction wheel 2T is provided with a knurled-type groover peripheral surface, and the back-up wheel or roller 2B is provided with a smooth peripheral surface. The binding strap 3 is of course interposed between the traction and back-up wheels or rollers 2T and 2B so as to be disposed within the bight or nip portion thereof within a predetermined amount of pressurized force developed therebetween.

According to this aforenoted conventional arrangement, the back-up wheel 2B is rotatably supported in such a manner that the same rotates about an axis b at a predeterminedly fixed position with respect to the frame portion of the binding head 1, while the traction wheel or roller 2T is rotatably incorporated within an eccentric mounting mechanism such that the traction wheel or roller 2T can approach the back-up wheel 2B in order to cooperate therewith in compressing the binding strap 3 therebetween. More particularly, the traction wheel 2T is eccentrically mounted upon an eccentric housing 5 by means of an eccentric shaft having an axis t about which traction wheel 2T rotates, and wherein the axis t of the traction wheel 2T and the eccentric shaft thereof is displaced by means of a a radial distance x from the pivotal base axis X of the eccentric housing 5. The structural arrangement is such that when the eccentric housing 5, which is operatively connected to a rotary motor 6 and a reduction gear drive 7 as shown in FIG. 6, is pivoted around the base axis X, the axis t is eccentrically moved with respect to axis X such that the traction wheel 2T can approach the back-up wheel 2B.

It is further appreciated that a spring 8 is interposed between the eccentric housing 5 and the frame of the binding head 1 such that the traction wheel 2T is always biased in the direction of engaging the back-up wheel 2B. In this manner, the spring 8 enables the driving wheel or driving roller system to feed or retract the binding strap 3 with a relatively small amount of pressure developed between the traction wheel 2T and the back-up wheel 2B. However, during the tightening, and particularly during the tensioning, phase of the binding operation, it is required that the binding strap 3 be strongly tensioned by means of a strong contact pressurized force and a strong traction torque developed by means of the traction wheel 2T. Such strong tensioning of the binding strap 3 is able to be achieved in the following manner. Upon completion of the initial strap tightening operation, the binding strap 3 encounters increased resistance to continued retraction in the tt direction, and when the traction wheel 2T is in fact operating in its reverse drive, low-speed, high-torque mode, the traction wheel 2T tends to be moved somewhat in the reverse direction tt as shown in FIG. 7. Accordingly, the traction wheel 2T will move, in effect, in a wedging direction in which the wedge angle $\alpha$, which is formed by, and subtends, the radial displacement x defined between the axes X and t of the eccentric housing 5 and the traction wheel 2T as the traction wheel 2T comes into contact with the back-up wheel 2B, will tend to be reduced. The wedge angle $\alpha$ usually has a predetermined value of approximately 5°–6° when the traction wheel 2T is engaged with the back-up wheel 2B, while the entire pivotable range of the eccentric housing 5 and traction wheel 2T is approximately 15°–30°. Accordingly, the pressurizing force developed between both wheels 2T and 2B is increased by means of the aforenoted wedging effect, and this phenomenon, wherein the tension within the strap is increased together with, in response to, or as a function of, the increase in the pressurizing force developed between both traction and back-up wheels 2T and 2B, respectively, is known as self-energization. Such self-energization phenomenon achieves the strong tensioning characteristics within the strapping band, and it is to be appreciated that when the steel band strap 3 has, for example, a width of 0.75–1.25 inches or 19–32 mm, a thickness of approximately 0.9 mm, and a tensile strength of approximately 75–100 kgs/mm$^2$, the pressing force developed between the traction wheel 2T and the back-up wheel 2B has a magnitude which is several times that of the strap tension.

As may readily be appreciated, the conventional strap-binding apparatus exhibits several drawbacks, problems, and operational disadvantages. As has been noted hereinabove, the binding strap may be forwardly fed or reversely retracted as a result of the development of a relatively small pressurizing force developed between the traction and back-up wheels 2T and 2B, respectively, in view of the disposition or presence of spring 8, and the adjustment of the spring or the resulting force may be readily achieved. For example, during tensioning of the binding strap, the pressurizing force developed between the traction and back-up wheels 2T and 2B, respectively, may be substantially increased when the wedge angle $\alpha$ is rendered small, and similarly, in reverse, that is, the pressurizing force may be reduced when the wedge angle $\alpha$ is rendered relatively large, considerable variations in the developed pressurizing force therefore being obtainable as a direct function, in an inverse manner, of the variation of the wedge angle $\alpha$. This structural arrangement, however, renders the adjustment quite difficult in view of the fact that optimum conditions under which the binding strap is tensioned without the development of slippage by means of the traction wheel 2T can vary with the type and thickness of the binding strap 3 employed. It is therefore practically impossible that predetermined setting conditions or adjustments of the wedge angle $\alpha$ will properly accommodate all types and thicknesses of binding straps to be used in such binding operations. If in fact the adjustment and tensioning conditions are not in fact properly set or predetermined, the binding strap may experience slippage. Such an operational occurrence not only fails to properly or smoothly tighten and tension the binding strap, but such also results in an effective loss of motor output. In a similar but reverse manner, if the pressurizing force is excessive, such a situation or condition may cause the grooves defined within the peripheral surface of the traction wheel 2T to bite into or gouge the binding strap, thereby imparting scar marks thereto. Such conditions may subsequently lead to the likelihood that during the final tensioning phase of the binding operation, the strap may tear or experience partial disintegration at such scar mark sites. Such conditions can of course lead to defective binding states.

Still further, it is also to be appreciated that in view of the eccentric mounting of the housing 5 having the drive system and traction wheel 2T operatively associated therewith, the housing 5 is necessarily large in size, and accordingly, the binding head 1 is necessarily large in size.

OBJECT OF THE INVENTION

Accordingly, it is an object of the present invention to provide a new and improved binding strap apparatus which is constructed in such a manner as to minimize or eliminate the aforenoted problems characteristic of the prior art conventional strap binding apparatus as noted hereinabove.

Another object of the present invention is to provide a new and improved binding strap apparatus which is substantially compact in size.

Still another object of the present invention is to provide a new and improved binding strap apparatus which is capable of developing the self-energization phenomenon in a proper and stable manner regardless of, or effectively accommodating, variations in the binding conditions during the strap tensioning phase of the binding operation.

Yet another object of the present invention is to provide a new and improved binding strap apparatus which is capable of easily adjusting the self-energization phenomenon in order to thereby enhance the range of binding conditions which may be operatively accommodated.

SUMMARY OF THE INVENTION

The foregoing and other objectives of the present invention are achieved through the provision of new and improved binding strap apparatus constructed in accordance with the present invention wherein fundamental modifications with respect to the convention apparatus are embodied. More particularly, in accordance with the present invention, the traction wheel 2T, which is operatively connected to the rotary drive or feeding system, has its rotary axis fixedly mounted upon the frame of the apparatus, and the back-up wheel 2B is eccentrically mounted with respect to the traction wheel 2T so as to thereby approach the traction wheel 2T and establish a proper relationship therewith in defining or developing the pressurizing force, torque transmission, and tightening tension in a well-balanced manner. Furthermore, provision is made such that the relationship defined between the traction wheel 2T and the back-up wheel 2B may be readily adjusted or altered by changing the mounting position of the eccentrically mounted back-up wheel 2B relative to the traction wheel 2T so as to thereby adjust the relative disposition of the traction wheel 2T and the back-up wheel 2B in order to properly accommodate the system to various different operating conditions, binding strap thickness dimensions, and the like.

More particularly, the binding strap apparatus of the present invention conventionally employs a traction wheel 2T and a back-up wheel 2B disposed within a binding head 1 and between which the binding strap 3 is fed in a forward feeding direction so as to cause the binding strap to encircle an article 4 to be bound. Upon completion of the encircling loop, the leading end portion 3*a* of the binding strap 3 is gripped by suitable gripping means disposed at a gripping station, and the trailing end portion 3*b* of the binding strap is rewound or retracted such that the binding strap 3 is now disposed about the article being bound in a substantially taut state without any looseness or slack. The trailing end portion 3*b* of the binding strap is then retracted or rewound further in the reverse direction so as to tightly tension the binding strap 3 about the article being bound. Upon achieving a properly tensioned state, the overlapped portions 3*a* and 3*b* of the binding strap 3 are then bonded together. Upon completion of the bonding operation, the trailing end portion 3*b* of the binding strap 3 is severed and separated from the residual supply portion 3*c* of the binding strap 3.

In accordance with the particularly unique and novel characteristics of the strap-binding apparatus constructed in accordance with the present invention, the traction wheel 2T is rotatably mounted upon a rotary axis thereof which is fixed within the binding head framework, and a supporting plate, which supports the drive system for rotatably driving the traction wheel 2T, is pivotably mounted upon the traction wheel axis. A spring is interposed between the supporting plate and the framework of the binding head such that the supporting plate is biased away from the binding head framework, and the back-up wheel 2B is fixedly mounted upon a rotary shaft which is eccentrically mounted upon or relative to a base axis of a support system whereby the back-up wheel 2B is rotatable about an axis which is eccentrically located with respect to the base support axis. In addition, the back-up wheel 2B is operatively connected to the supporting plate by means of a lever fixedly connected to the eccentric shaft of the back-up wheel 2B, and a linkage member which interconnects the free end of the lever to the supporting plate.

In accordance with the structural system of the present invention, the pressurizing force developed between the traction wheel 2T and the back-up wheel 2B during the time in which the binding strap is being forward fed or reversely retracted may of course be adjusted by means of the spring loading or biasing force as is similarly achieved in the conventional apparatus system. However, in accordance with further characteristics of the present invention, the traction wheel 2T, for developing the self-energization phenomenon along or in cooperation with the back-up wheel 2B, is fixedly disposed at a predetermined position within the binding head framework, and the back-up wheel 2B is adjustably eccentrically mounted for relative movement with respect to the traction wheel 2T so as to engage the traction wheel 2T in a more accurately or precisely controlled manner whereby, in turn, or as a function thereof, the pressurizing force developed between the traction wheel 2T and the back-up wheel 2B can be more accurately or precisely controlled. As a result, the tension forces or degree of tension imparted to the binding strap during the tensioning phase of the binding operation is properly developed and generated, and concomitantly therewith, excessive pressurizing forces are not, and need not be, developed within the system. Accordingly, the resulting or developed pressurizing forces achieved in accordance with the present invention are able to, in effect, be effectively reduced as compared to those generated by means of the conventional apparatus or system, while the same degree of tension is in fact developed within the binding strap. These results will be discussed more fully later in this application wherein test results will be set forth in a tabulated mode whereby it will become clearly apparent that by means of the present invention, a predetermined strap-binding tension level can be achieved with a reduced pressurizing force as compared to the conventional system or apparatus. The enhanced tension-generating effect, as compared to the developed pressurizing force, may also be further facilitated by predeterminedly selecting or fabricating the cross-sectional shape of each one of the grooves or knurled portions defined upon the peripheral surface of the traction wheel 2T. In accordance with the present invention, the aforenoted adjustable eccentric mounting of the back-up wheel relative to the traction wheel and the supporting plate is achieved by means of the hereinbefore noted linkage-lever assembly. In particular, the linkage member is interconnected to the free end of the lever at one end thereof and is interconnected to the supporting plate at the other end thereof. The interconnection means may comprise a pin-pin hole arrangement, and a plurality of pin holes may be provided upon the supporting plate whereby depending upon the selective pin-pin hole interconnection, the disposition of the back-up wheel 2B relative to the supporting plate and the traction wheel 2T, with the resulting adjustability in the pressurizing force and resulting tension, can be readily achieved.

It is lastly noted as an additional favorable characteristic of the present invention that in view of the fixed location or disposition of the traction wheel 2T upon the binding head framework, the binding head, and the overall binding apparatus, may be rendered more compact.

BRIEF DESCRIPTION OF THE DRAWINGS

Various other objects, features, and attendant advantages of the present invention will be better appreciated from the following detailed description, when considered in connection with the accompanying drawings, in which like reference characters designate like or corresponding parts throughout the several views, and wherein:

FIG. 3(*a*) is an enlarged, schematic, side elevation view of the peripheral surface of a conventional prior art back-up wheel;

FIG. 3(*b*) is a view similar to that of FIG. 3(*a*) showing however the peripheral surface of a back-up wheel constructed in accordance with the principles of the present invention;

FIG. 4(*a*) is a perspective view of a testing machine for performing tension/pressurizing force tests concerning the traction and back-up wheels with respect to the binding strap interposed therebetween;

FIG. 4(*b*) is a side elevation view schematically showing the disposition the traction and back-up wheels, and the binding strap interposed therebetween, as employed within the testing apparatus of FIG. 4(*a*);

DETAILED DESCRIPTION OF THE ILLUSTRATED EMBODIMENTS

Figure 1:
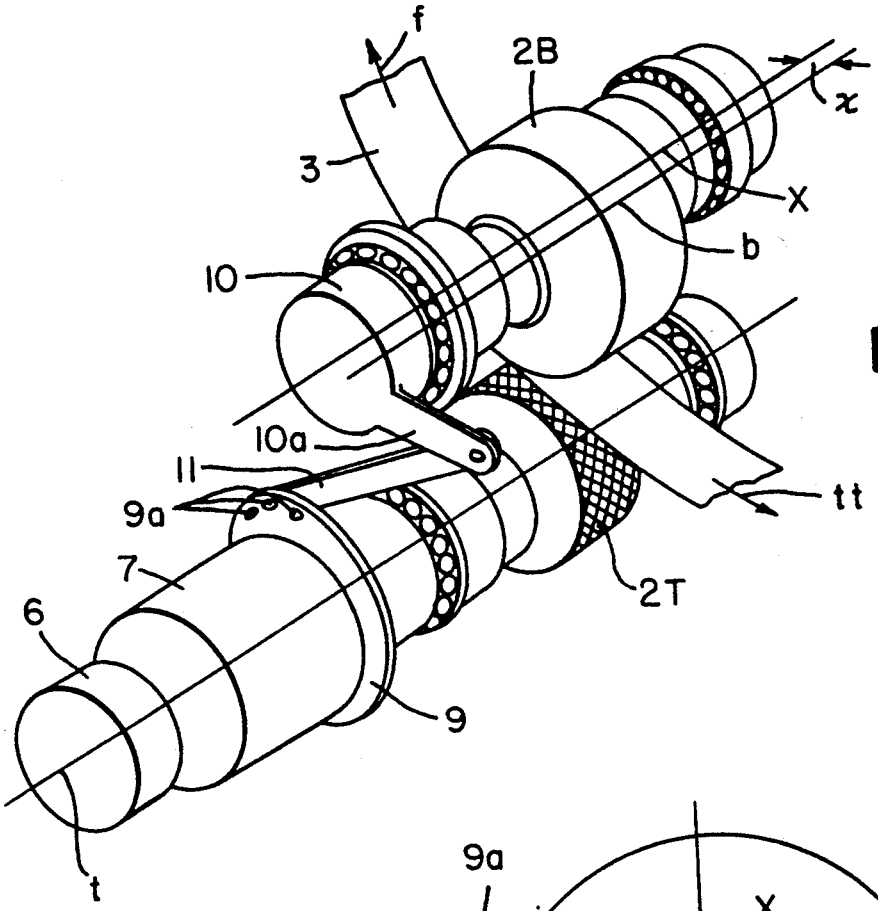
FIG. 1 is a perspective view of the main components of the new and improved strap binding apparatus constructed in accordance with the present invention and showing the cooperative parts thereof which are to be incorporated within the binding head.
Figure 2:
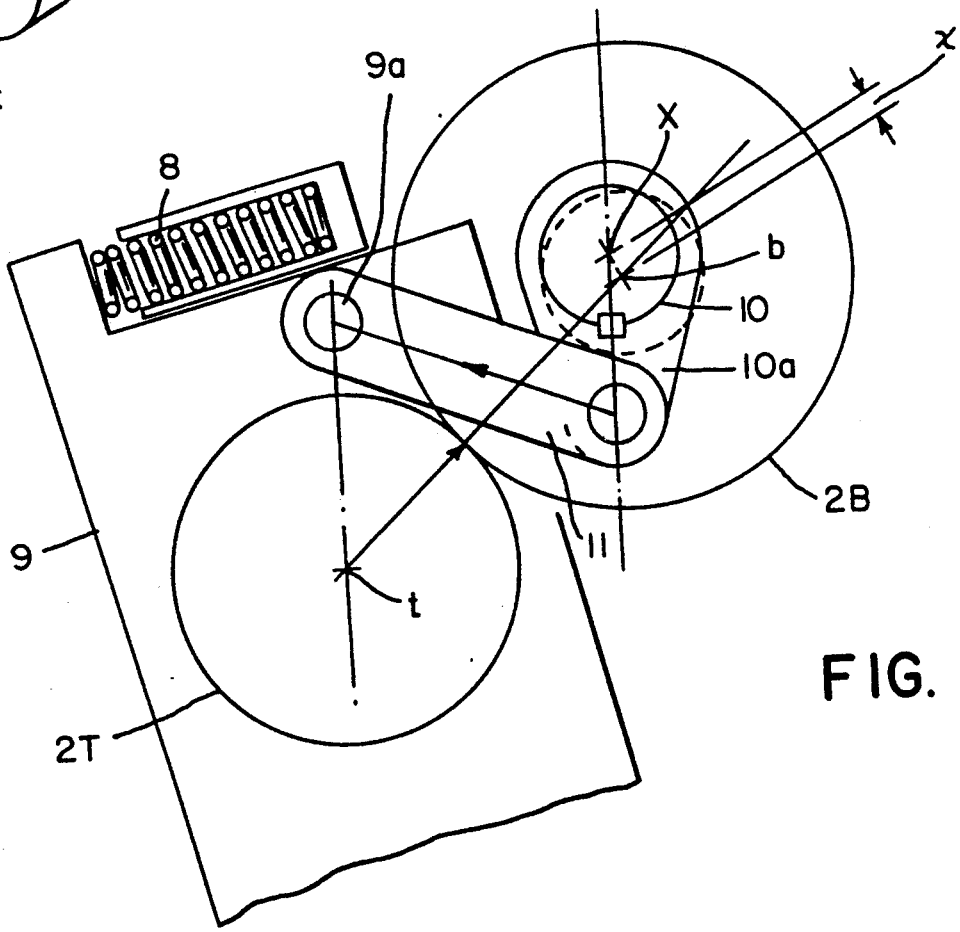
FIG. 2 is a schematic view, in side elevation, of the operative components of the strap binding apparatus shown in FIG. 1.
Figure 5:
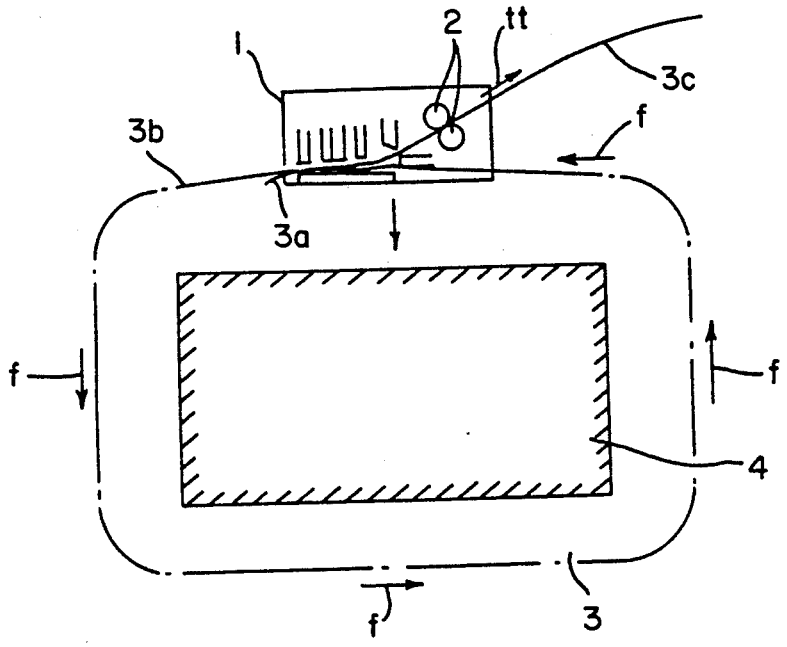
FIG. 5 PRIOR ART
FIG. 5 is a side elevation view schematically illustrating a strap binding operation with respect to an article being bound, as is conventional in the prior art.
Figure 6:
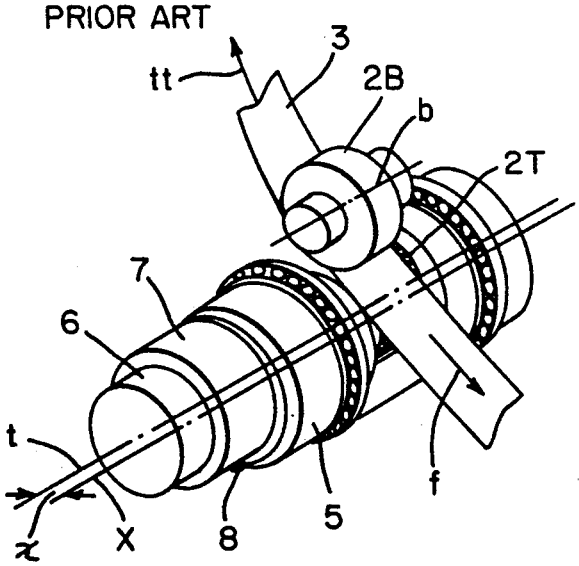
FIG. 6 PRIOR ART
FIG. 6 is a perspective view, similar to that of FIG. 1, showing however a PRIOR ART arrangement of the traction and back-up wheels with the binding strap interposed therebetween.
Figure 7:
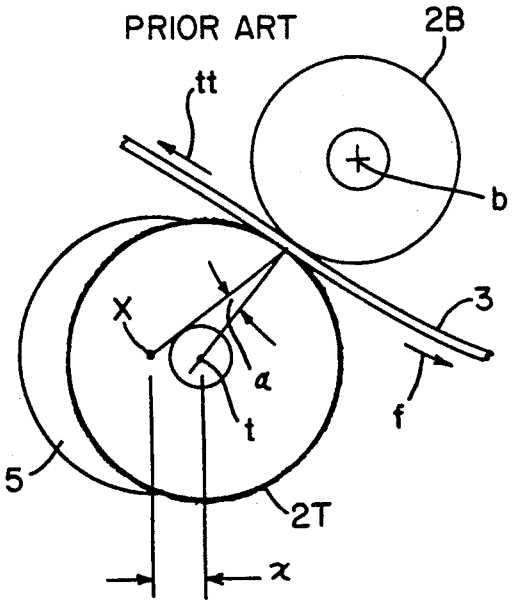
FIG. 7 PRIOR ART
FIG. 7 is a side elevation view, similar to that of FIG. 2, schematically showing however the relative disposition of the traction and back-up wheels during forward feeding and reverse rewinding of the binding strap.

Referring again to the drawings, and more particularly to FIGS. 1 and 2 thereof, there is shown cooperating traction wheel 2T and back-up wheel 2B components of the strap bind-apparatus system constructed in accordance with the present invention system, and wherein such system may of course be readily incorporated within a binding head 1 as illustrated in FIG. 5 so as to perform a strap binding operation which comprises the operative steps of feeding a binding strap 3 in the forward direction, by means of the wheels or rollers 2T and 2B, such that the binding strap 3 encircles an article 4 to be bound. Upon completion of the encirclement of the article 4 by means of the binding strap 3, the leading end portion 3*a* of the binding strap 3 is gripped by means of a gripping device, not shown, disposed at a gripping station, and the trailing end portion 3*b* of the binding strap 3 is then retracted or rewound as a result of the reverse drive of the traction and back-up wheels 2T and 2B, respectively. After tightening the binding strap 3 about article 4 so as to achieve a non-slack state, the trailing end portion 3*b* of the binding strap is retracted or rewound further such that the binding strap 3 is now characterized by means of a tensioned state. The overlapped portions 3*a* and 3*b* of the binding strap 3 are then bonded to each other by suitable means, and the trailing end portion 3*b* of the binding strap is then severed and separated from the residual supply portion 3*c* of the binding strap 3.

In accordance with the particular improvements characteristic of the present invention, as compared to a conventional strap binding system, it is initially seen that the traction wheel 2T is rotatably supported, within the framework of the binding head 1, so as to be drivingly rotated about an axis t which is fixedly located within the binding head 1. The traction wheel 2T is operatively connected to a rotary drive system which includes a driving motor 6 and a reduction gearing system 7 wherein the latter motor and gearing components 6 and 7 are mounted upon a drive system supporting plate 9 which is pivotable about the traction wheel axis t. A coil spring 8 is interposed between the binding head framework and the supporting plate 9 such that the plate 9 is biased so as to be pivoted in the counterclockwise direction.

The back-up wheel 2B is also supported upon the framework of the binding head but in such a manner that an eccentric shaft 10 thereof is pivotable about a base axis X which is disposed parallel to the axis t of the traction wheel 2T such that the back-up wheel 2B can approach the traction wheel 2T, back-up wheel 2B also being rotatable in cooperation with the traction wheel 2T, for performance of the binding strap forward feeding and reverse rewinding operations, about an axis b which is disposed parallel to axes t and X of the traction wheel 2T and eccentric shaft 10, respectively, and which is additionally displaced by means of an eccentric amount x from the base axis X of the eccentric shaft 10. The back-up wheel 2B is preferably provided with self-aligning bearings.

The eccentric shaft 10 includes a lever portion 10*a*, and it is seen that one end portion of a linkage member 11 is connected to the free end portion of the lever 10*a*, while the opposite end portion of the linkage member 11 is connected to the supporting plate 9 by means of a connecting pin, not shown, which may be selectively engaged within any one of a plurality of pin holes 9*a* formed within the supporting plate 9 as best seen in FIG. 1. Accordingly, the counterclockwise pivotal movement of the rotary drive system supporting plate 9 causes the eccentric shaft 10 to be pulled and rotated in the clockwise direction through means of the linkage member 11 and the lever 10*a* interconnecting the eccentric shaft 10 with the supporting plate 9 such that the back-up wheel 2B approaches the traction wheel 2T and also undergoes a predetermined angular pivotal movement. The relative angle of such angular pivotal movement may thus readily be appreciated as being adjustable either by changing the length of the linkage member 11 so as to alter the distance defined between the lever 10*a* and the preselected hole 9*a* of the supporting plate 9, or alternatively, by changing the preselected pin hole 9*a* to which the linkage member 11 is to be connected. As a result of such changes, the wedge angle $\alpha$ to be defined at the time when both the traction wheel 2T and the back-up wheel 2B come into contact with each other may be appropriately changed or adjusted.

According to the structural arrangement or system of the present invention, when the binding strap 3 is fed or retracted by means of the cooperating traction and back-up wheels 2T and 2B, respectively, the eccentric shaft 10 is pivotably rotated in an eccentric manner by means of the biasing force of spring 8 acting upon the supporting plate 9, and as transmitted to shaft 10 through means of linkage member 11 and lever 10*a*, whereby the back-up wheel 2B comes into contact with the traction wheel 2T, and is maintained in such state of compression or engagement with traction wheel 2T by means of the biasing force of the spring 8. When the binding strap 3 is conveyed in the reverse direction for performance of the tightening and tensioning operations, the back-up wheel 2B engages the traction wheel 2T with an even greater force due to the aforenoted self-energizing phenomenon as defined or determined by means of the wedging angle and the wedge effect produced thereby. Accordingly, a large amount of torque is able to be transmitted from the drive system of motor 6 and reduction gearing 7 to the traction wheel 2T and, in turn, to the binding strap 3 without the latter experiencing any slippage thereof, whereby the binding strap 3 is in fact tightened under high tension conditions but without an excessive amount of pressurizing force being imparted to the binding strap 3 interposed between the traction wheel 2T and back-up wheel 2B.

In order to in fact further control the pressurizing force to desirable levels with respect to the degree of tension to be developed within the binding strap 3 during the high tensioning phase thereof, each of the grooves formed within the peripheral surface of the traction wheel 2T of the present invention has a cross-sectional configuration which comprises that of a triangle none of whose sides are equal, as illustrated in FIG. 3(*b*), and wherein a relatively large apex angle, and more obtuse or flattened surface, is presented in the retraction and tensioning direction tt as compared with much smaller apex angles, and sharper or more acute surfaces, presented to the binding strap 3 in accordance with the conventional surface configuration of the traction wheel 2T as shown in FIG. 3(*a*) wherein the cross-sectional configuration of each groove of the peripheral surface of such conventional traction wheel 2T comprises that of an equilaterial triangle. As a result of such constructional configuration of the grooves of the peripheral surface of the traction wheel 2T of the present invention, the pressurizing force required for achieving the desired degree of tension within the binding strap 3 may be effectively reduced, such as, for example, from 8 tons to 6.5 tons, and the depth h of each one of the peripheral grooves is also accordingly reduced as can be seen from the comparison of the present invention traction wheel 2T of the present invention as disclosed in FIG. 3(*b*) when the same is compared to a conventional traction wheel 2T as seen in FIG. 3(*a*). Such a reduction in the pressurizing force effectively reduces the marking scars conventionally produced by means of the traction wheel 2T upon the binding strap 3 due to the bight cooperation, impressed upon binding strap 3, by means of the traction wheel 2T along with back-up wheel 2B.

In order to obtain and confirm the aforenoted relationships between the binding strap tension and the pressurizing force developed between the traction wheel 2T and the back-up wheel 2B, in connection with both the conventional and present invention structural arrangements or systems, testing was conducted upon the systems or arrangements of both the PRIOR ART and present invention, the test arrangement for the system of the present invention being disclosed in FIG. 4(*b*) wherein the eccentric amount of the back-up wheel 2B was 5 mm, and the testing apparatus is disclosed in FIG. 4(*a*). In conducting the experimental testing, the binding strap 3 was maintained by and between the traction wheel 2T and the back-up wheel 2B, and the pressurizing force was adjusted by means of an adjusting screw 14, while the strap tension was adjusted by means of screws 15. The test results are shown in the following TABLE I for both the PRIOR ART and present invention systems:

TABLE I

| Sample | Strap Tension (kgf) | Pressing Force (kgf) |
|---|---|---|
| PRIOR ART | | |
| A | 1600 | 3750 |
| B | 2000 | 5000 |
| C | 2200 | 5750 |
| PRESENT INVENTION | | |
| A | 1600 | 3000 |
| B | 2000 | 4000 |
| C | 2200 | 5000 |

The pressing force noted in TABLE I refers to the maximum value which can be applied before occurrence of slippage of the binding strap, and it can readily be appreciated from the results of TABLE I that in accordance with the present invention, an equivalent strap tension can be attained by means of the implementation or impression of a small pressurizing force upon the binding strap than that required in accordance with the PRIOR ART conventional systems or apparatus.

In accordance with the present invention, it is thus seen that the self-energization of the binding strap during tightening and tensioning thereof proceeds smoothly and in a controlled manner, and without slippage of the binding strap whereby driving power losses are minimized. In addition, such a system as that of the present invention enables the binding strap to be tensioned with a relatively small pressurizing force whereby deleterious scarring or marking of the binding strap is effectively prevented. Still further, and in accordance therewith, the selective adjustability of the system, and particularly the disposition of the back-up wheel 2B relative to the traction wheel 2T, enables the system to accommodate variations within binding conditions, binding straps per se, and the like, so as to thereby enhance the applicable or useful range of the present invention apparatus. Still yet further, the apparatus of the present invention may be effectively included within a relative compact binding head.

Obviously, many modifications and variations of the present invention are possible in light of the above teachings. It is therefore to be understood that within the scope of the appended claims, the present invention may be practiced otherwise than as specifically described herein.

I claim:

1. Apparatus for feeding, taking up, and tensioning a binding strap, comprising:
- a traction wheel;
- a back-up wheel operatively associated with said traction wheel for defining a gap therebetween within which a portion of said binding strap can be disposed for movement in a forward feeding and reversed retraction directions so as to achieve feeding and tensioning binding operations;
- a pivotable support plate upon which one of said traction and back-up wheels is mounted;
- means for eccentrically mounting the other one of said traction and back-up wheels such that said two wheels can relatively approach, and separate from, each other so as to respectively retain said binding strap within said gap, and permit introduction of said binding strap into said gap;
- lever means connected to said means for eccentrically mounting said other one of said traction and back-up wheels;
- connecting link means for connecting said lever means to said support plate; and
- spring means for biasing said support plate in a direction which will cause said eccentrically mounted wheel to be moved toward said one of said wheels in response to the biasing force of said spring means being transmitted to said eccentrically mounting means through said support plate, said connecting link means, and said lever means.

2. Apparatus as set forth in claim 1, wherein:
- said traction wheel is mounted upon said support plate.

3. Apparatus as set forth in claim 2, wherein:
- said pivotable support plate is pivotable about a predetermined axis; and
- said traction wheel is rotatable about said predetermined axis of said support plate.

4. Apparatus as set forth in claim 1, wherein:
- said back-up wheel is mounted upon said eccentrically mounting means.

5. Apparatus as set forth in claim 1, wherein said connecting link means comprises:
- a connecting link; and
- a first connecting pin mounted upon a first end of said connecting link for selective disposition within one of a plurality of holes defined within said support plate; and a second connecting pin mounted upon a second end of said connecting link for connection to said lever.

6. Apparatus as set forth in claim 1, wherein said eccentrically mounting means comprises:

an eccentric shaft upon which said back-up wheel is eccentrically mounted.

7. Apparatus as set forth in claim 1, wherein:

said traction wheel comprises a peripheral surface which has groove means defined therein for engaging said binding strap.

8. Apparatus as set forth in claim 7, wherein:

said groove means are defined by means which have triangular configurations as seen in cross-section.

9. Apparatus as set forth in claim 8, wherein:

the triangular configuration of each groove means is that of a non-equilateral triangle.

10. Apparatus as set forth in claim 1, wherein:

said spring means is interposed between said support plate and a binding head framework portion of said apparatus.

* * * * *